United States Patent [19]

Pozzobon

[11] Patent Number: 4,741,115

[45] Date of Patent: May 3, 1988

[54] SKI BOOT WITH AN OPERATING ASSEMBLY FOR THE CLOSING AND ADJUSTMENT DEVICES

[75] Inventor: Alessandro Pozzobon, Paderno Di Ponzano Veneto, Italy

[73] Assignee: Nordica S.p.A., Montebelluna TV, Italy

[21] Appl. No.: 932,810

[22] Filed: Nov. 19, 1986

[30] Foreign Application Priority Data

Dec. 2, 1985 [IT] Italy ..... 23045 A/85

[51] Int. Cl.[4] ..... A43B 5/04; A43C 11/00

[52] U.S. Cl. ..... 36/117; 36/50; 24/68 SK

[58] Field of Search ..... 36/117–121, 36/50, 137; 24/68 SK

[56] References Cited

U.S. PATENT DOCUMENTS 4,112,601 9/1978 Chiaramonte, Jr. ..... 36/137
4,633,599 1/1987 Morell et al. ..... 36/50
4,653,204 3/1987 Morell et al. ..... 36/117
4,660,300 4/1987 Morell et al. ..... 36/50
4,680,878 7/1987 Pozzobon et al. ..... 36/117

FOREIGN PATENT DOCUMENTS 2448872 9/1980 France ..... 36/117
2570257 3/1986 France ..... 36/119
2572258 5/1986 France ..... 36/119

*Primary Examiner*—James Kee Chi
*Attorney, Agent, or Firm*—Guido Modiano; Albert Josif

[57] ABSTRACT

The ski boot with an operating assembly for the closing and adjustment devices comprises a power source supported by the ski boot and operating a driving gearwheel which is selectively engageable with driven gearwheels for the winding of cables of closing and/or adjustment devices of the boot. Members are furthermore provided for removably blocking the unwinding of said cables.

7 Claims, 2 Drawing Sheets

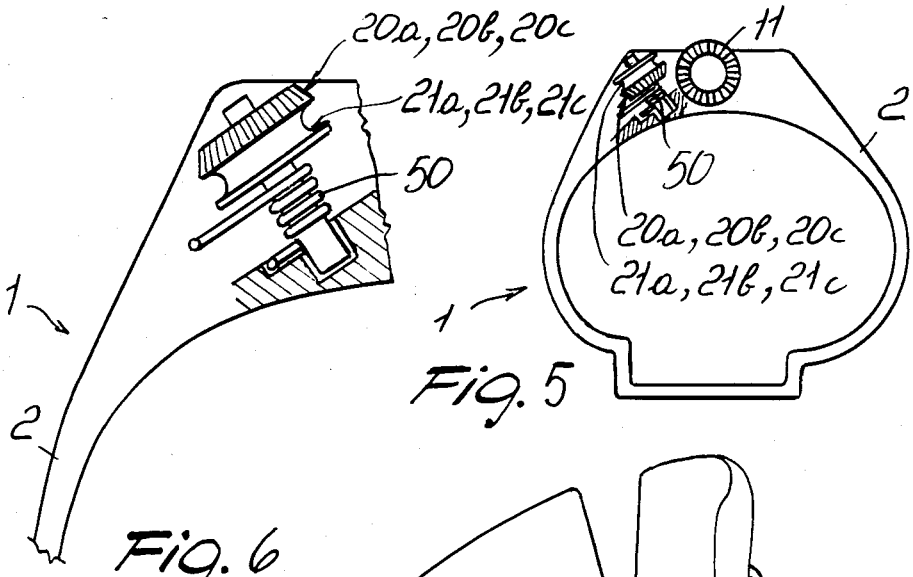
Fig. 5
Fig. 6
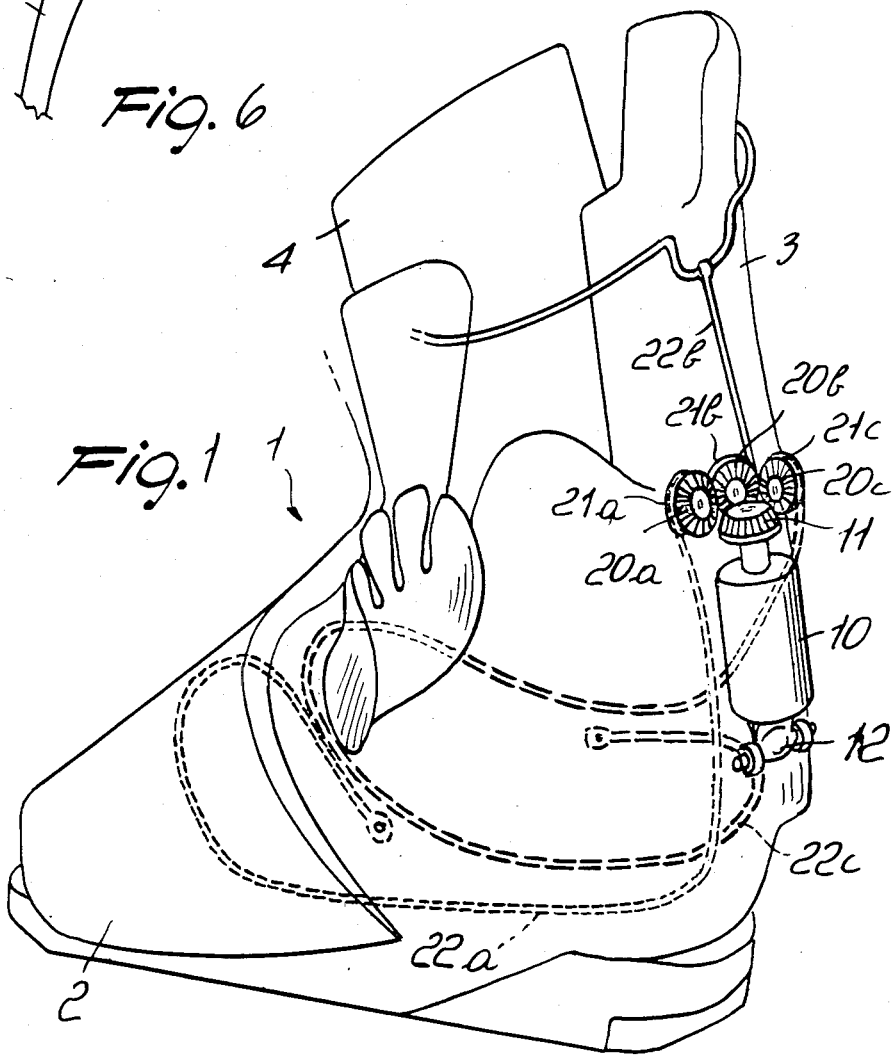
Fig. 1

SKI BOOT WITH AN OPERATING ASSEMBLY FOR THE CLOSING AND ADJUSTMENT DEVICES

BACKGROUND OF THE INVENTION

The present invention relates to a ski boot with an operating assembly for the closing and adjustment devices.

As is known, in ski boots various devices are currently employed which perform the closing of the boot, bringing together the quarters, in the case of rear-entry ski boots, as well as all the internal adjustments of the boot such as, e.g., the securing of the foot instep, the securing of the heel, and so on.

In the prior art, all the above described functions are performed by means of devices which have an independent actuation, which can be composed of a closing lever, a spool which winds a cable, and the like.

Therefore, the user must perform a long series of operations by acting on the various devices, which are usually positioned in various points of the boot, with obvious disadvantages and difficulties in performing these actuations.

SUMMARY OF THE INVENTION

The aim proposed by the invention is indeed to eliminate the above described disadvantages by providing a ski boot with an operating assembly for the closing and adjustment devices which in practice allows centralization of the control of the various devices, thus simplifying the execution both of the closing of the boot and of any adjustments required.

Within the scope of the above described aim, a particular object of the invention is to provide a ski boot wherein the control of the various devices is provided in a position which is easily accessible and connectable, automatically and when required, to the device to be operated, without therefore giving rise to the need to provide the various actuations in different points of the boot.

Still another object of the present invention is to provide a ski boot with an operating assembly for the closing and adjustment devices which offers the possibility of making all the functions automatic, thus allowing the exertion of relatively high forces both in closing and adjustment, without thereby requiring particular efforts on the part of the user.

Another object of the present invention is to provide a ski boot which is extremely practical and versatile in use, offering the user remarkable convenience in operation.

This aim and the objects described, as well as others which will better appear hereinafter, are achieved by a ski boot with an operating assembly for the closing and adjustment devices, according to the invention, characterized in that it comprises a power source supported by the ski boot and operating a driving gearwheel which is selectively engageable with drive gearwheels for the winding of cables of closing and/or adjustment devices of the boot, means being furthermore provided for the removable blocking of the unwinding of said cables.

BRIEF DESCRIPTION OF THE DRAWINGS

Further characteristics and advantages of the invention will become apparent from the following detailed description of some preferred, but not exclusive, embodiments of a ski boot with an operating assembly for the closing and adjustment devices, illustrated by way of non-limitative example in the accompanying drawings, wherein:

FIG. 1 is a schematic perspective view of a ski boot with the power source applied to the rear portion;

FIG. 5 is a schematic view of the means for the removable blocking of the unwinding of the cables; and FIG. 6 is an enlarged and more detailed view of the means for the removable blocking of the unwinding of said cables.

DESCRIPTION OF THE PREFERRED EMBODIMENTS

Figure 4:
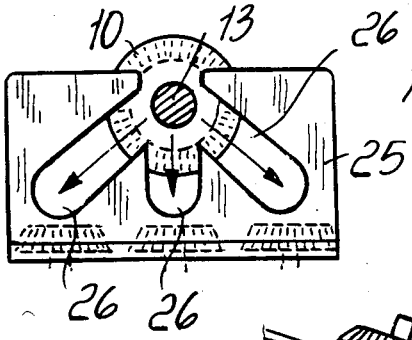
FIG. 4 is a cross section view along the line IV—IV of FIG. 3.
Figure 3:
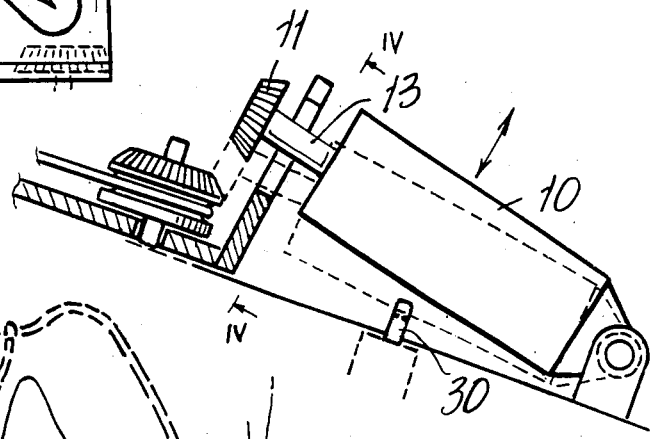
FIG. 3 is a schematic view of the power supply.

With reference to the above described figures, the ski boot with an operating assembly for the closing and adjustment devices, according to the invention, which is generally indicated by the reference numeral 1, comprises, in a per se known manner, a shell 2 to which are associated, in the case of rear-entry ski boots, a rear quarter 3 and a front quarter 4.

The peculiarity of the invention resides in the fact that it comprises a power source, expediently composed of an electric motor 10, having an associated reduction gear which drives a driving gearwheel 11, advantageously, but not necessarily, composed of a conical gearwheel.

Figure 2:
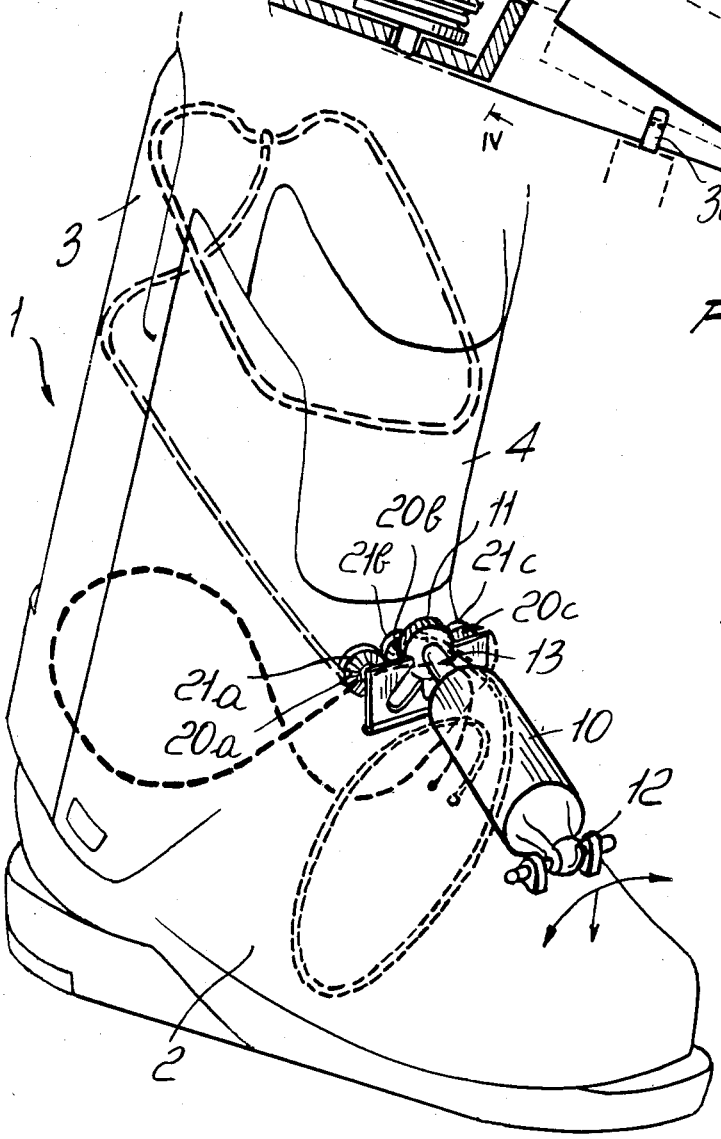
FIG. 2 is a schematic perspective view of a ski boot with the power source applied to the front portion of the boot.

Said motor 10 can be connected in any point of the boot and, merely as an example, in FIGS. 1 and 2 a ski boot is illustrated with the motor 10 applied rearwardly and with the motor 10 applied in the front part.

The motor 10 is connected to the ski boot by means of an articulated joint, indicated by the reference numeral 12, which allows the possibility of oscillation of the motor both around the longitudinal axis of the motor itself and around an axis perpendicular to the extension of the motor.

The motor 10 is electrically connected to batteries or rechargeable accumulators (not illustrated in the drawing) which can be accommodated in recesses defined by the boot, preferably in the lower part.

Said motor 10 is selectively engageable with driven winding gearwheels, which, in this case, by way of example, are composed of a first, a second and a third gearwheel respectively indicated by the reference numerals 20*a*, 20*b*, and 20*c*.

The driving gearwheel 11 is selectively engageable with one of the driven gearwheels.

For this purpose, a selector is provided, composed of a plate 25 which defines guiding slots 26 in which the small axle 13 of the driving gearwheel 11 engages so as to guide the engagement between the driving gearwheel and the driven gearwheels.

Another peculiarity of the invention resides in the fact that the actuation of the motor 10 occurs upon the engagement between the driving gearwheel and the driven gearwheels.

For this purpose, a switch 30 is provided, interposed on the electric feed line between the motor and the battery or accumulator, which is actuated when the user acts on the motor to perform the engagement between the gearwheels.

Said driven gearwheels 20*a*, 20*b*, and 20*c* are rigidly connected to respective pulleys 21*a*, 21*b*, and 21*c*, around which corresponding cables are wound, designated with the reference numerals 22*a*, 22*b* and 22*c* which, in the specific example, are assigned to the boots' closure and various adjustments.

More in detail, the first cable 22*a* performs the blocking of the heel with a per se known path of the cable, the second cable 22*b* performs the reciprocal closing of the quarters, while the third cable performs the actuation of the foot instep presser.

Obviously, as previously mentioned, it is possible to provide a plurality of adjustment devices, all of which can be operated by virtue of the single power source which is selectively engageable with one device or the other.

Means are furthermore provided for the removable blocking of the unwinding of the cables from the respective pulleys, which have the function of allowing winding of the cable on the pulley, when the motor 10 is actuated, but at the same time preventing the accidental uncoiling or unwinding of the same cable.

According to what has been illustrated in the accompanying drawings, said blocking means are composed of a pin-spring 50 which winds around the axle of each pulley and has a direction of winding such that the actuation of the motor causes no braking of any kind, while when the cable tends to unwind, imparting a rotation to the pulley in the opposite direction, it performs a blocking braking action on the axle.

Obviously, means are furthermore provided, comprising, for example, a lever, a push-button or the like which are externally accessible and which allow release of said blocking means, to permit, when required by the user, the unwinding of the cable.

It is also possible to employ removable blocking means of a different kind, such as e.g. a saw-tooth wheel which engages with a ratchet gear, or other equivalent solutions.

In practical use, the user, once he has put on the ski boot according to the invention, to perform the required closing and adjustments, needs to simply exert a pressing action on the motor, inserting it in the slot which matches the selected function.

The oscillation imparted to the motor causes the actuation of the switch, with the consequent closing of the electric power supply circuit of the same motor and the rotation of the driving gearwheel which transmits its motion to the driven gearwheel engaged with the driving gearwheel.

The motor may be made to oscillate, to actuate the switch, both manually and by means of a ski stick, according to its positioning on the ski boot.

It should be furthermore added that the motor may be positioned in any point of the ski boot deemed suitable.

From what has been described, it can be seen therefore that the invention achieves the intended aim, and in particular the fact is stressed that a single power source is provided which is selectively and easily associatable with the chosen devices, thus performing all the functions which are normally provided in a ski boot.

Another important feature of the invention resides in the fact that it is possible for the user to exert the required closing forces without having to exert significant efforts.

The invention thus conceived is susceptible of numerous modifications and variations, all of which are within the scope of the inventive concept.

Furthermore, all the details can be replaced by other technically equivalent elements.

In practice, the materials employed, so long as compatible with the specific use, as well as the dimensions and the contingent shapes, may be any according to requirements.

I claim:

1. Ski boot with closing and adjustment devices having cables, and an operating assembly for the closing and adjustment devices, said ski boot comprising a power source, said power source being supported by said ski boot and operating a driving gearwheel, said driving gearwheel being selectively engageable with driven gearwheels, said driven gearwheels being adapted for winding said cables of said closing and adjustment devices of said ski boot, said ski boot further comprising means for removably blocking unwinding of said cables.

2. Ski boot according to claim 1, wherein said power source is composed of an electric motor, said electric motor being connected to an electric power supply, said electric power supply being accommodated inside said ski boot.

3. Ski boot, according to claim 2, further comprising an articulated joint, said articulated joint being adapted for connecting said electric motor to said ski boot.

4. Ski boot, according to claim 2, wherein said electric motor further comprises an electric power supply circuit having a switch, and wherein said motor is adapted for oscillation for engaging said driving gearwheel with one of said driven gearwheels, said switch of said electric power supply circuit being actuated by said motor during said oscillation of said motor for engaging said driving gearwheel with one of said driven gearwheels.

5. Ski boot, according to claim 1, further comprising a selector, said selector having a plurality of slots, said driving gearwheel having an axle, said plurality of slots being adapted for accommodating said axle of said driving gearwheel and for acting as a guiding element, for guiding engagement of said driving gearwheel with at least one of said driven gearwheels.

6. Ski boot, according to claim 1, further comprising pulleys, said pulleys being rigidly coupled to said driven gearwheels.

7. Ski boot according to claim 6, wherein said pulleys are adapted for winding and unwinding said cables and wherein said means for removably blocking unwinding of said cables are composed of pin-springs, said driven gearwheels having axles, each of said pin-springs being associated with one of said axles of said gearwheels, each of said cables defining a direction of unwinding, each said axle being adapted for rotation in said direction of unwinding of said cables, said pin-springs each being adapted for tightening on said one of said axles upon rotation of said one of said axles in said direction of unwinding of said cables, said ski boot further comprising means for uncoupling said pinsprings from said axles, said means for uncoupling said pinsprings from said axles being externally accessible and adapted for permitting unwinding of said cables from said pulleys.

* * * * *